US011732481B2

(12) United States Patent
Jain

(10) Patent No.: US 11,732,481 B2
(45) Date of Patent: Aug. 22, 2023

(54) CANTILEVER STAIR ASSEMBLY

(71) Applicant: Construction & Design Solutions, Inc., Seattle, WA (US)

(72) Inventor: Ranjiv Jain, Seattle, WA (US)

(73) Assignee: CONSTRUCTION DESIGN & SOLUTIONS, INC., Seattle, WA (US)

( * ) Notice: Subject to any disclaimer, the term of this patent is extended or adjusted under 35 U.S.C. 154(b) by 0 days.

(21) Appl. No.: 16/976,860

(22) PCT Filed: Mar. 4, 2019

(86) PCT No.: PCT/US2019/020583
§ 371 (c)(1),
(2) Date: Aug. 31, 2020

(87) PCT Pub. No.: WO2019/169399
PCT Pub. Date: Sep. 6, 2019

(65) Prior Publication Data

US 2020/0407979 A1 Dec. 31, 2020

Related U.S. Application Data

(60) Provisional application No. 62/638,050, filed on Mar. 2, 2018.

(51) Int. Cl.
*E04F 11/022* (2006.01)
*E04F 11/112* (2006.01)
*E04F 11/02* (2006.01)

(52) U.S. Cl.
CPC ..... *E04F 11/0223* (2013.01); *E04F 11/112* (2013.01); *E04F 2011/0209* (2013.01)

(58) Field of Classification Search
CPC . E04F 11/0223; E04F 11/0201; E04F 11/022; E04F 11/035; E04F 11/1045;
(Continued)

(56) References Cited

U.S. PATENT DOCUMENTS 3,381,775 A * 5/1968 Livers ..... E04F 11/1812 182/228.2
3,713,511 A * 1/1973 Hinkle ..... E06C 9/06 182/95
(Continued)

FOREIGN PATENT DOCUMENTS

DE 1965697 A1 * 7/1971 ..... E04F 11/0223
DE 2615049 A1 * 10/1977 ..... E04F 11/0223
(Continued)

OTHER PUBLICATIONS

Int'l Search Report and Written Opinion dated Jun. 13, 2019 in Int'l Application No. PCT/US2019/020583.

*Primary Examiner* — Kyle J. Walraed-Sullivan
(74) *Attorney, Agent, or Firm* — Panitch Schwarze Belisario & Nadel LLP

(57) ABSTRACT

A cantilever stair assembly for installation in segments or sections includes a stair tread module including a stair tread plate having a tread hole. An embedded stair tread is inserted into and fixed within the tread hole. The stair tread module may include a first inner wall stair tread support and a second inner wall stair tread support for mounting to opposite sides of a vertical support member. Each of the first and second inner wall stair tread supports has a first plate with a plurality of support-member-engagement holes therethrough and a second plate perpendicular to the first plate and having a plurality of stair-tread-plate-engagement holes therethrough. The stair tread plate is secured to at least one of the plurality of stair-tread-plate-engagement holes of each of the first and second inner wall stair tread supports.

17 Claims, 17 Drawing Sheets

(58) Field of Classification Search
CPC ..... E04F 11/112; E04F 11/032; E04F 2011/0203; E04F 2011/0209
See application file for complete search history.

(56) References Cited

U.S. PATENT DOCUMENTS

| | | | | | |
|---|---|---|---|---|---|
| 3,932,972 | A * | 1/1976 | Rossman | E04F 11/0255 | 52/183 |
| 4,373,609 | A * | 2/1983 | De Donato | E04F 11/035 | 182/178.2 |
| 5,636,483 | A * | 6/1997 | Wille | E04F 11/0255 | 182/228.1 |
| 9,091,083 | B1 * | 7/2015 | Goudreau | E04F 11/0223 | |
| 2015/0284962 | A1 * | 10/2015 | Meier | E04B 2/56 | 52/184 |
| 2016/0369514 | A1 * | 12/2016 | Grommet | E04F 11/112 | |

FOREIGN PATENT DOCUMENTS

| | | | |
|---|---|---|---|
| DE | 0009302685 | U1 | 5/1993 |
| DE | 0019850061 | A1 | 5/2000 |
| EP | 2481865 | A2 | 8/2012 |

* cited by examiner

CANTILEVER STAIR ASSEMBLY

CROSS REFERENCE TO RELATED APPLICATIONS

The present application is a Section 371 of International Application No. PCT/US2019/020583, filed Mar. 4, 2019, which was published Sep. 6, 2019 under International Publication No. WO 2019/169399 A1, and claims the benefit of U.S. Provisional Patent Application No. 62/638,050, filed on Mar. 2, 2018 and titled "Cantilever Stair Assembly", the entire contents of which are incorporated herein by reference in their entirety.

BACKGROUND OF THE INVENTION

The present invention relates generally to the field of construction, and more particularly, to the construction of stairs, and still more particularly, to the construction of cantilever stairs.

In the construction of buildings, situations arise in which it is desirable to construct cantilever stairs—that is, stairs comprising a plurality of stair treads that are supported in a cantilever fashion by a wall or other structure. Cantilever stairs may be used in the construction of a new building or portion thereof or in the construction of new or replacement stairs in an existing building. Cantilever stairs provide flexibility to designers, who gain the option to have stairs having no supporting structure on one end, as well as the option to forego support from a structure that might be capable of providing support, but only with design constraints that impose high costs—for example, structures that use glass walls to provide support for stairs.

To achieve attractive finished stairs in a building that is being constructed or renovated, prior art methods and systems often require a builder to construct temporary stairs for use during construction so that the temporary stairs absorb any wear or damage related to construction. When construction is complete or nearly complete, the builder then removes the temporary stairs and builds permanent stairs. This process requires additional effort compared to installing stairs only once. The preferred invention overcomes certain of the deficiencies of known cantilever stairs. Certain preferred embodiments of the present invention can save time and money by allowing a builder to avoid installing stairs twice at the same location.

Presently preferred embodiments of the invention provide assemblies for constructing cantilever stairs suitable for typical exterior and interior applications. Some prior cantilever stairs include a plurality of stair treads supported by a steel plate connecting to the studs or other vertical support structure of a building and running the length of a flight of stairs. Cantilever stairs constructed in this fashion require precision within one sixteenth of an inch (1/16") over the entire length of the stairs. In a preferred embodiment, the present invention enables the installation of cantilever stairs using a plurality of separately installed stair tread modules. This method of installation does not require the same level of precision and does not pose the same potential for errors and rework as such prior cantilever stairs.

BRIEF SUMMARY OF THE INVENTION

In one aspect, a preferred embodiment of a cantilever stair assembly for installation in segments or sections comprises a stair tread module including a stair tread plate having a tread hole. An embedded stair tread is inserted into and fixed within the tread hole. The stair tread module may include a first inner wall stair tread support and a second inner wall stair tread support for mounting to opposite sides of a vertical support member. Each of the first and second inner wall stair tread supports has a first plate with a plurality of support-member-engagement holes therethrough and a second plate perpendicular to the first plate and having a plurality of stair-tread-plate-engagement holes therethrough. The stair tread plate is secured to at least one of the plurality of stair-tread-plate-engagement holes of each of the first and second inner wall stair tread supports.

In some embodiments, the first plate of each of the first and second inner wall stair tread supports has a plurality of support-member-engagement holes therethrough, and the second plate of each of the first and second inner wall stair tread supports has a plurality of stair-tread-plate engagement holes. Each of the first and second inner wall stair tread supports is mounted to the vertical support member by at least one fastener passing through at least one of the plurality of support-member-engagement holes. The stair tread plate is secured to each of the first and second inner wall stair tread supports by at least one fastener passing through at least one of the stair-tread-plate-engagement holes of each of the first and second inner wall stair tread supports.

In certain embodiments, the first plate of the first inner wall stair tread support is angled with respect to the second plate thereof.

In certain embodiments, the first inner wall stair tread support has a longitudinal axis and a cross section perpendicular thereto. The cross section has a base, a first leg angled with respect to the base, and a second leg angled with respect to the base.

In another aspect, a second preferred embodiment of a cantilever stair assembly comprises an inner wall stair tread bracket and an inner wall tread bracket support for mounting to opposite sides of a vertical support member, the inner wall tread bracket support having at least one support-member-engagement hole for a fastener for engaging the vertical support member, and the inner wall stair tread bracket having a support-engagement section with a plurality of support-member-engagement holes and a stair-base support section with at least one horizontal fastener fixed thereto, wherein the stair tread plate of the stair tread module is secured to at least one of the horizontal fasteners of the stair-base support section.

In certain embodiments, the stair-base support section has a horizontal fastener fixed thereto, and the horizontal fastener is a bolt welded to the stair-base support section.

In certain embodiments, the cantilever stair assembly includes a plurality of stair tread modules.

In certain embodiments, an outer stair tread is included for enclosing the embedded stair tread.

In certain embodiments, an outer stair tread plate is provided for engaging a structure, the outer stair tread plate being fastened to the outer stair tread at an opposite end thereof from the stair tread plate

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
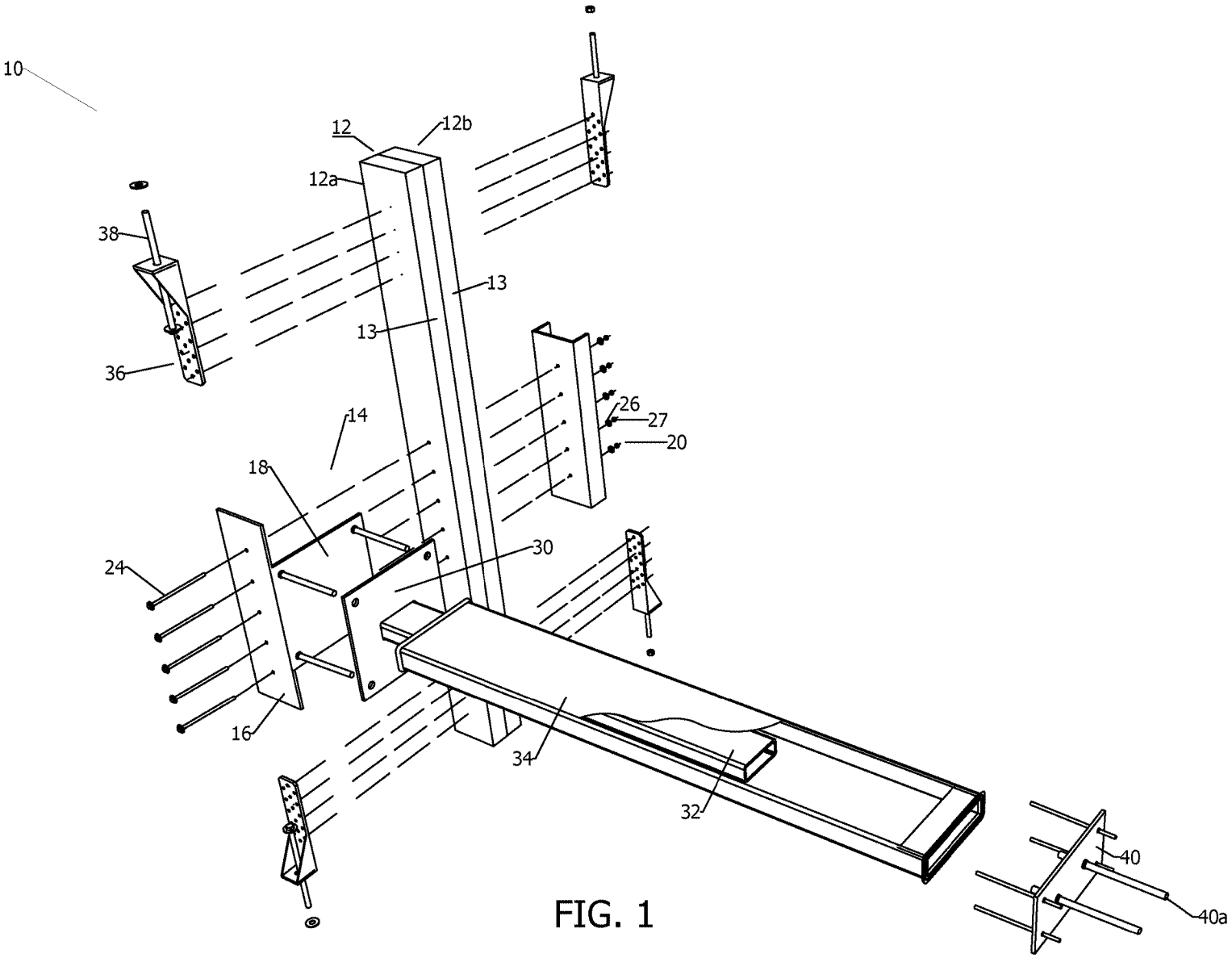
FIG. 1 is a front left exploded perspective view of a first preferred embodiment of a stair assembly according to the preferred invention.

Certain terminology is used in the following description for convenience only and is not limiting. The words "right," "left," "lower," and "upper" designate directions in the drawings to which reference is made. The words "inner" and "outer" refer to directions toward and away from, respectively, the geometric center of the device and designated parts thereof. Unless specifically set forth herein, the terms "a," "an," and "the" are not limited to one element but instead should be read as meaning "at least one." The terminology includes the words noted above, derivatives thereof, and words of similar import.

The various holes recited in this application preferably are round but alternatively are oval, rectangular, or any other suitable shape. As noted above, the dimensions shown on the drawings and discussed in the text are illustrative and not limiting. Other dimensions are within the scope of the invention, provided that the other dimensions are consistent with the requirements of a particular assembly and the dimensions of the individual components are generally compatible.

Figure 2:
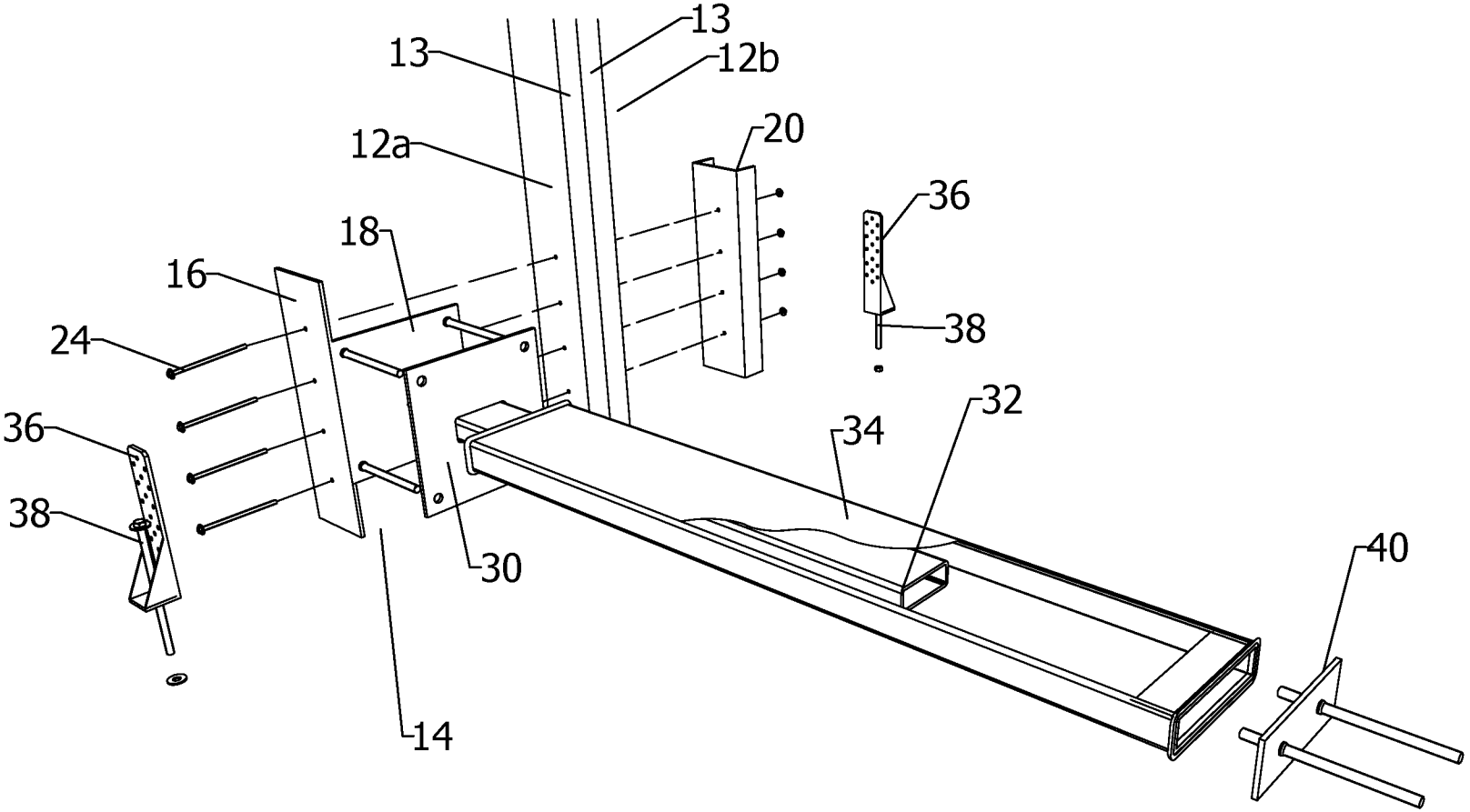
FIG. 2 is a front left exploded perspective view of a portion of the stair assembly of FIG. 1.
Figure 3A:
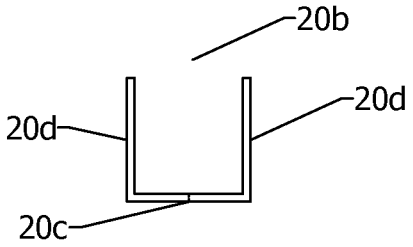
FIG. 3A is a top plan view of a bracket support of the stair assembly of FIG. 1.
Figure 3B:
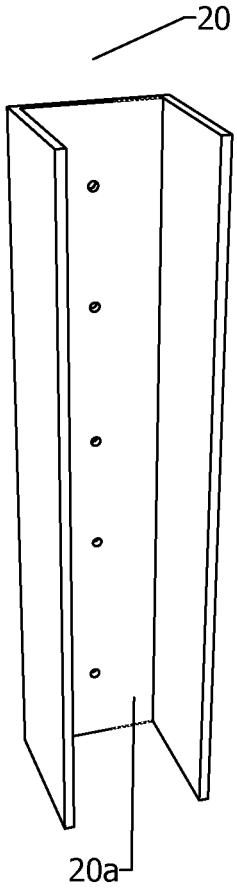
FIG. 3B is a front left perspective view of the bracket support of FIG. 3A.
Figure 3C:
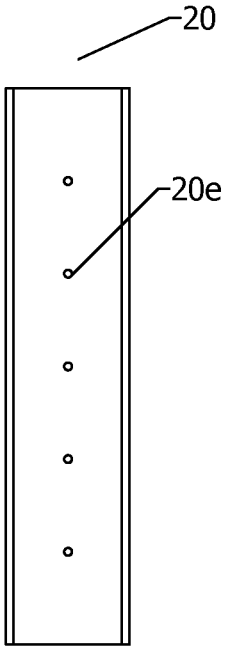
FIG. 3C is a front elevational view of the bracket support of FIG. 3A.
Figure 3D:
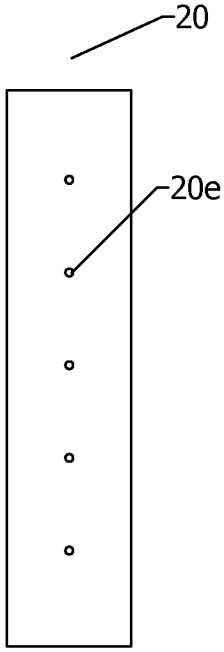
FIG. 3D is a rear elevational view of the bracket support of FIG. 3A.
Figure 4A:
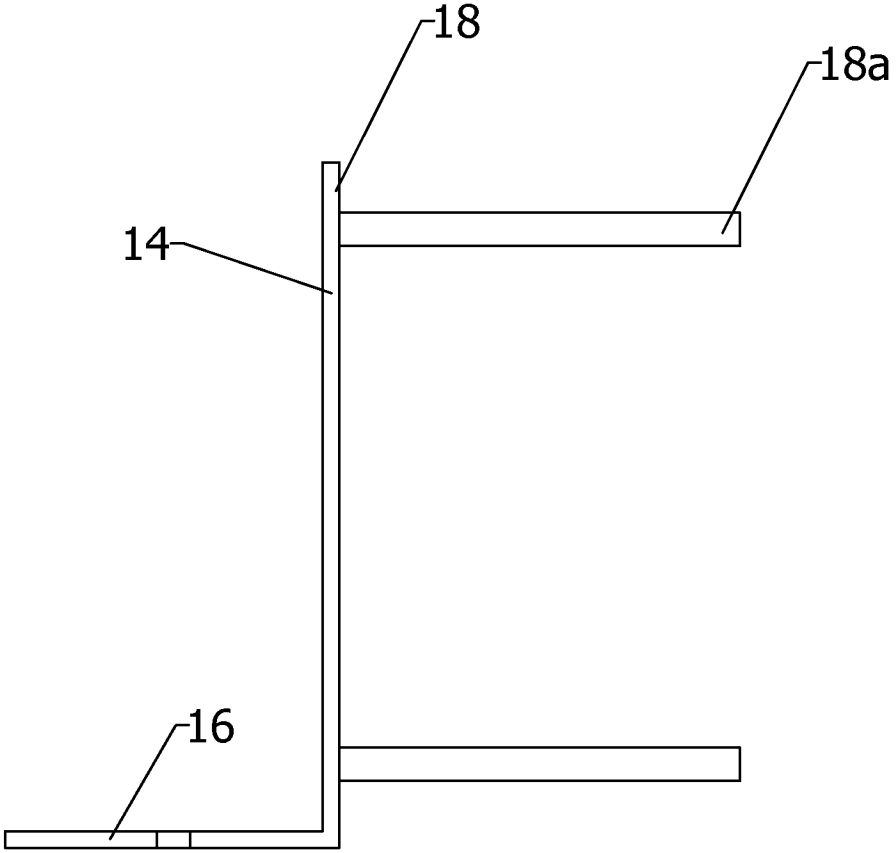
FIG. 4A is a top plan view of a stair tread bracket of the stair assembly of FIG. 1.
Figure 4B:
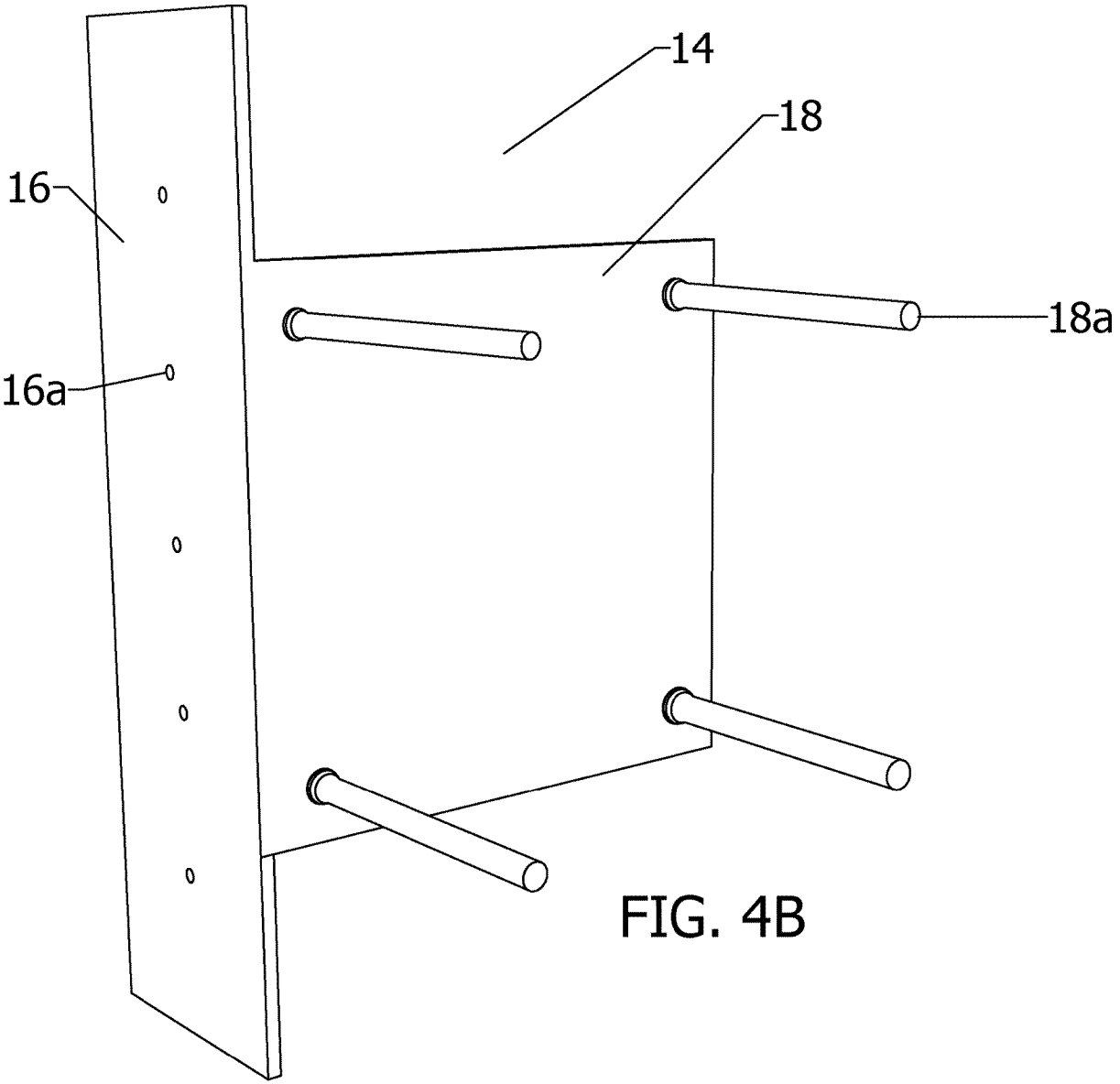
FIG. 4B is a front left perspective view of the stair tread bracket FIG. 4A.
Figure 4D:
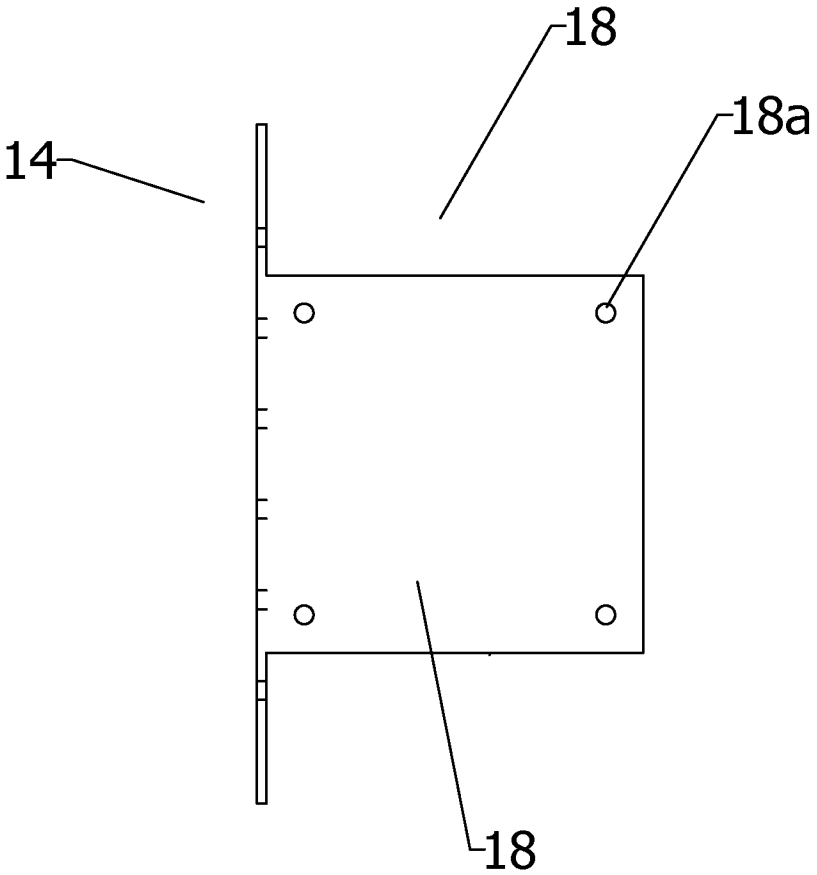
FIG. 4D is a front elevational view of the stair tread bracket of FIG. 4A.
Figure 4C:
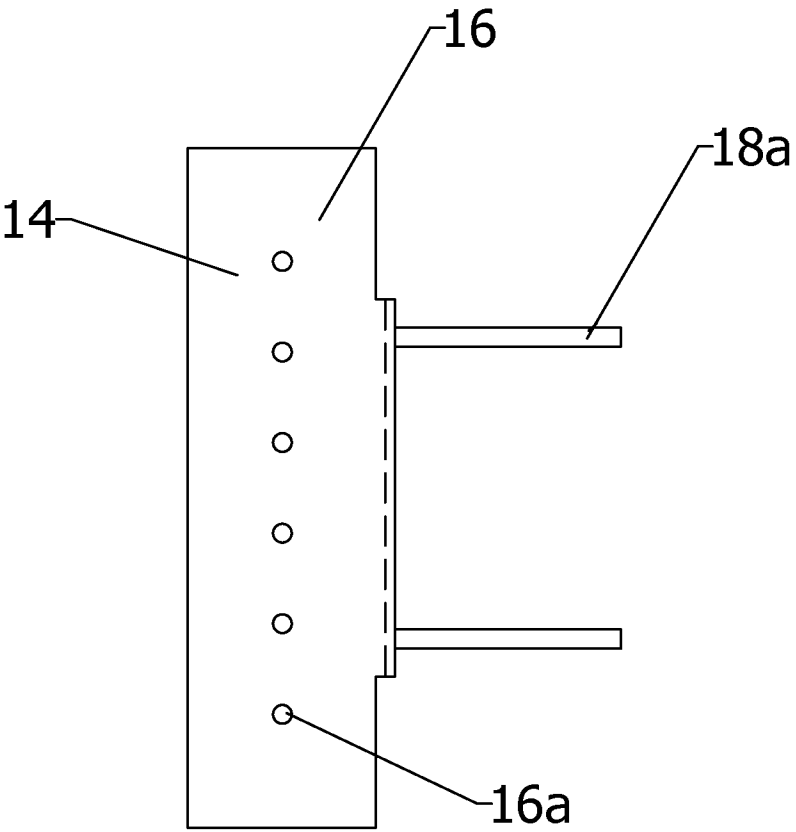
FIG. 4C is a left elevational view of the stair tread bracket of FIG. 4A.
Figure 14:
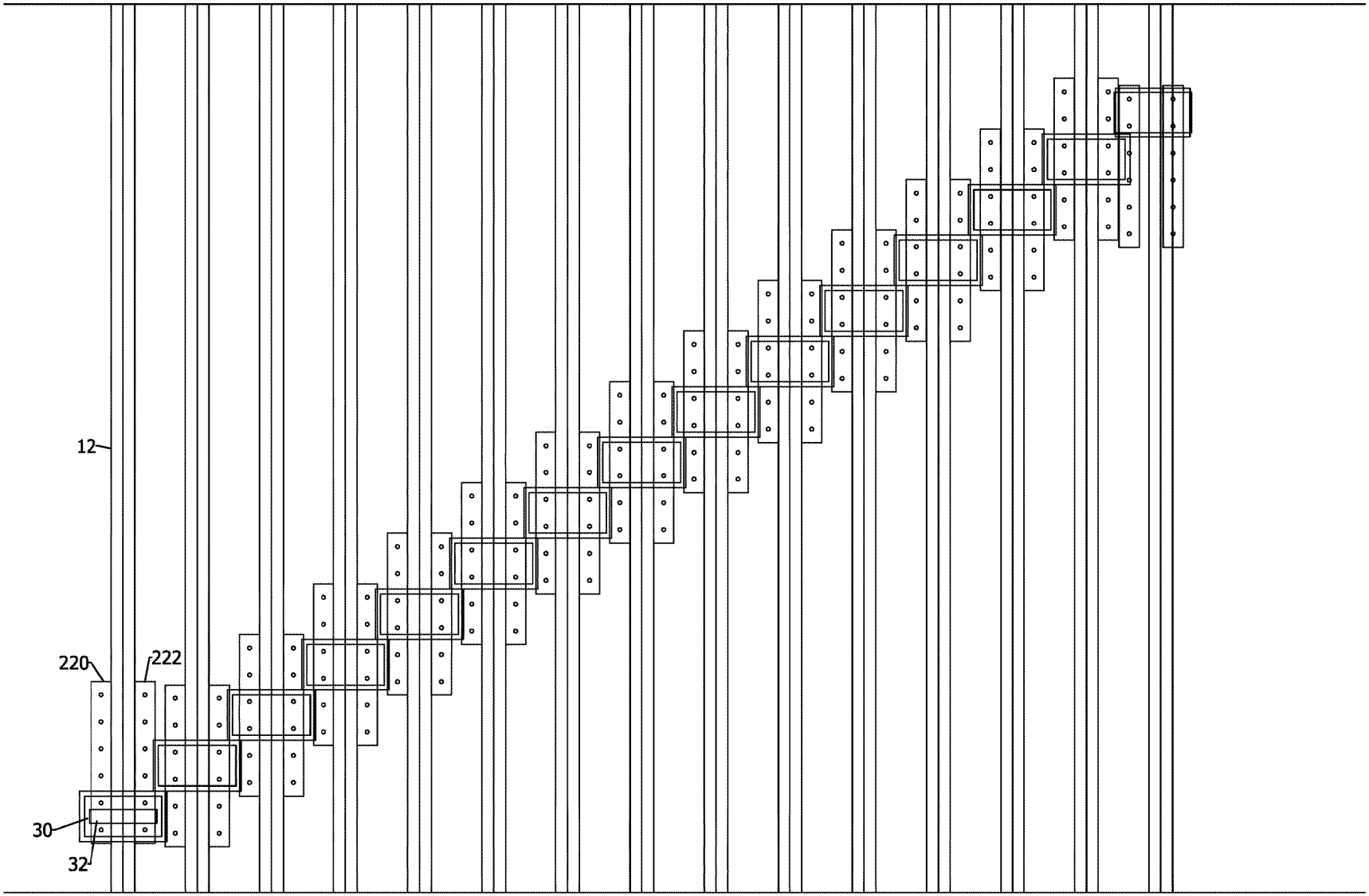
FIG. 14 is a front elevational partial schematic view of a cantilever stair assembly comprising a plurality of stair tread modules in accordance with a preferred embodiment of the present invention.

Referring to FIGS. 1-11, a first preferred embodiment of the present invention is directed to a cantilever stair assembly 10. The cantilever stair assembly 10 is preferably for installation in segments and sections to form a complete set of stairs (FIG. 14) or a portion of a set of stairs by installing the cantilever stair assembly 10 including a plurality of stair tread modules 28 according to one or more embodiments of the preferred invention. Referring to FIGS. 1 and 2, the inner wall stair tread assembly 10 is mounted and attached to a vertical support member 12, which as depicted is formed from a pair of studs 12*a*, 12*b*, which may be comprised of timber studs 12*a*, 12*b* although not so limited, forming a portion of a wall of a building, with each timber stud 12*a*, 12*b* having a face 13 parallel to the surface of the wall. The vertical support member 12 could alternatively be any structural member having the necessary dimensions and strength—for example, a stud or post made from steel or other material. The cantilever stair assembly 10 connects to the vertical support member 12 by way of an inner wall stair tread bracket 14 and an inner wall tread bracket support 20, which are mounted and attached to opposite sides of the vertical support member 12.

Referring to FIGS. 3A-3D, the inner wall tread bracket support 20 has a longitudinal axis 20*a* and a generally C-shaped cross-section 20*b* with a base 20*c* and two legs 20*d*. The base 20*c* forms a support-engagement section of the inner wall tread bracket support 20 and has at least one support-member-engagement hole 20*e* for a fastener such as a bolt or screw for engaging the vertical support member 12. In the first preferred embodiment, the inner wall tread bracket support 20 has a plurality of support-member-engagement holes 20*e* passing through the base 20*c* of the cross-section 20*b*.

Referring to FIGS. 4A-4D, the inner wall tread bracket support 14 includes a support-engagement section 16 and a stair-base support section 18, which in a typical installation (as shown in FIGS. 1 and 2) is joined to the support-engagement section 16 at or near a right angle. The support-engagement section 16 and the stair-base support section 18 are preferably integrally formed as one body as shown but may be formed as two bodies joined together by welding or mechanical fasteners. The support-engagement section 16 preferably has at least one support-member-engagement hole 16*a*, and in the illustrated first preferred embodiment has a plurality of support-member-engagement holes 16*a* therethrough. Referring again to FIGS. 1 and 2, the support-member-engagement holes 16*a* of the support-engagement section 16 are alignable with the holes 20*e* of the inner wall tread bracket support 20, with a plurality of inner wall stair tread bracket bolts 24 passing through the holes 20*e*, 16*a* to join the inner wall stair tread bracket 14 to the vertical support member 12 and the studs 12*a*, 12*b*. Each inner wall stair bracket bolt 24 is preferably secured by a washer 26 and a nut 27. The washer 26 may optionally take the form of a combination lock nut-washer, and as used herein, "washer" includes combination lock nut-washers as well as conventional washers. The nut 27 preferably is coated with vinyl and thus has a vinyl surface 27*a*. Examples of suitable or preferred bolts, nuts, and washers are shown in in FIGS. 5A and 5B, but a variety of other bolts, screws, and fasteners may be used. For example, a wood screw 25, such as the example shown in FIG. 6, may be substituted for one or more of the inner wall stair tread bracket bolts 24.

Referring to FIGS. 4A-4D, the stair-base support section 18 of the inner wall stair tread bracket 14 has fixed thereto at least one horizontal fastener. In the first preferred embodiment of FIGS. 4A-4D, the stair-base support section 18 has horizontal fasteners in the form of four bolts 18*a* fastened thereto, and in the illustrated first preferred embodiment welded thereto. In a preferred embodiment, the bolts 18*a* are sufficiently long to accommodate a thickness of a wall material that may be arranged between the face 13 of the vertical support member 12 and the external surface (not shown) of the building wall. In practice, bolts one-half inch in diameter and at least six inches (6") in length are effective in many applications, but other dimensions are possible consistent with the requirements of the assembly.

Figure 9B:
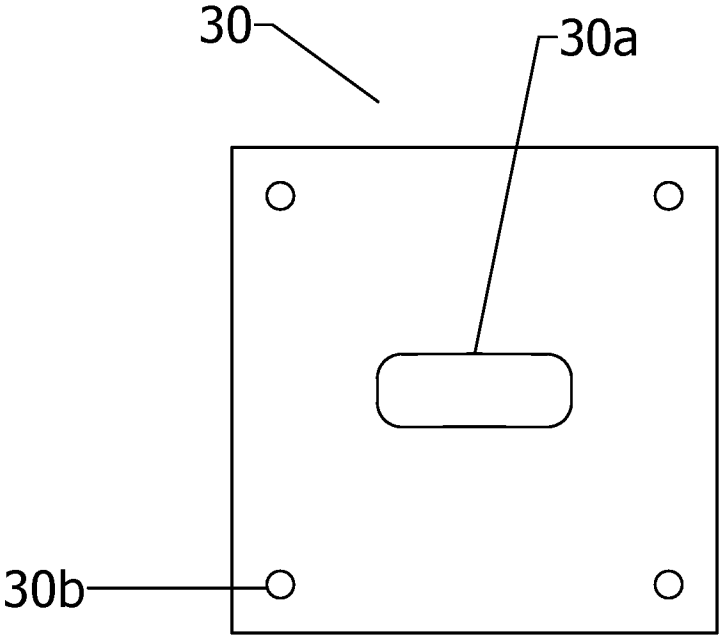
FIG. 9B is a front elevational view of the stair tread plate of FIG. 9A.
Figure 9A:
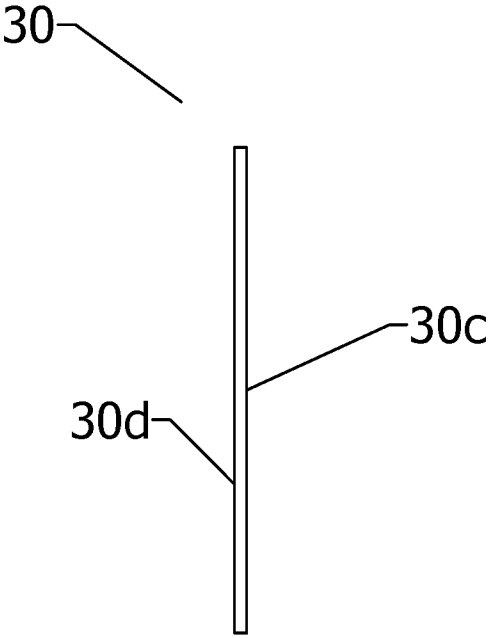
FIG. 9A is a top plan view of a stair tread plate of the stair assembly of FIG. 1.

Referring again to FIGS. 1 and 2, the cantilever stair assembly 10 further comprises a stair tread module 28 including a stair tread plate 30; an embedded stair tread 32 having a first end 32*a*, a second end 32*b*, and a longitudinal axis 32*c*; and an outer stair tread 34 having a first end 34*a*, a second end 34*b*, and a longitudinal axis 34*c*. Referring to FIGS. 9A and 9B, the stair tread plate 30 includes a tread hole 30*a* and one or more mounting holes, which in FIG. 9B are shown as four bolt holes 30*b*. In the first preferred embodiment, the stair tread plate 30 is a planar body with a square shape measuring about ten inches (10") on each side and about half an inch (½") in thickness. The stair tread plate 30 of the stair tread module 28 is preferably secured to at least one of the horizontal fasteners (the bolts 18*a* in the illustrated embodiment) of the stair-base support section and may be secured to each of the horizontal fasteners.

Referring to FIGS. 8A-10B, attached to the stair tread plate 30 is the embedded stair tread 32, which preferably is inserted into the tread hole 30*a* and fixed within the tread hole 30*a*. In the illustrated first preferred embodiment, the embedded stair tread 32 is welded at the first end 32*a* at both the front surface 30*c* and the rear surface 30*d*, preferably using a fillet weld 42 (see FIGS. 10A and 12). An outer stair tread 34, which may be provided for enclosing the embedded stair tread 32, encircles, radially encloses, and is fitted to the embedded stair tread 32 and in the illustrated first preferred embodiment is welded at the first end 34*a* to the stair tread plate 30, with the outer stair tread 34, the embedded stair tread 32, and the stair tread plate 30 together forming the stair tread module 28. Preferably the stair tread module 28 is not assembled in the field and is instead provided in an assembled state, ready for connection to an inner wall stair tread bracket 14 or to be otherwise suitably supported—for example, by being embedded in a concrete wall and optionally engaging a rebar component of a concrete wall.

Figure 8A:
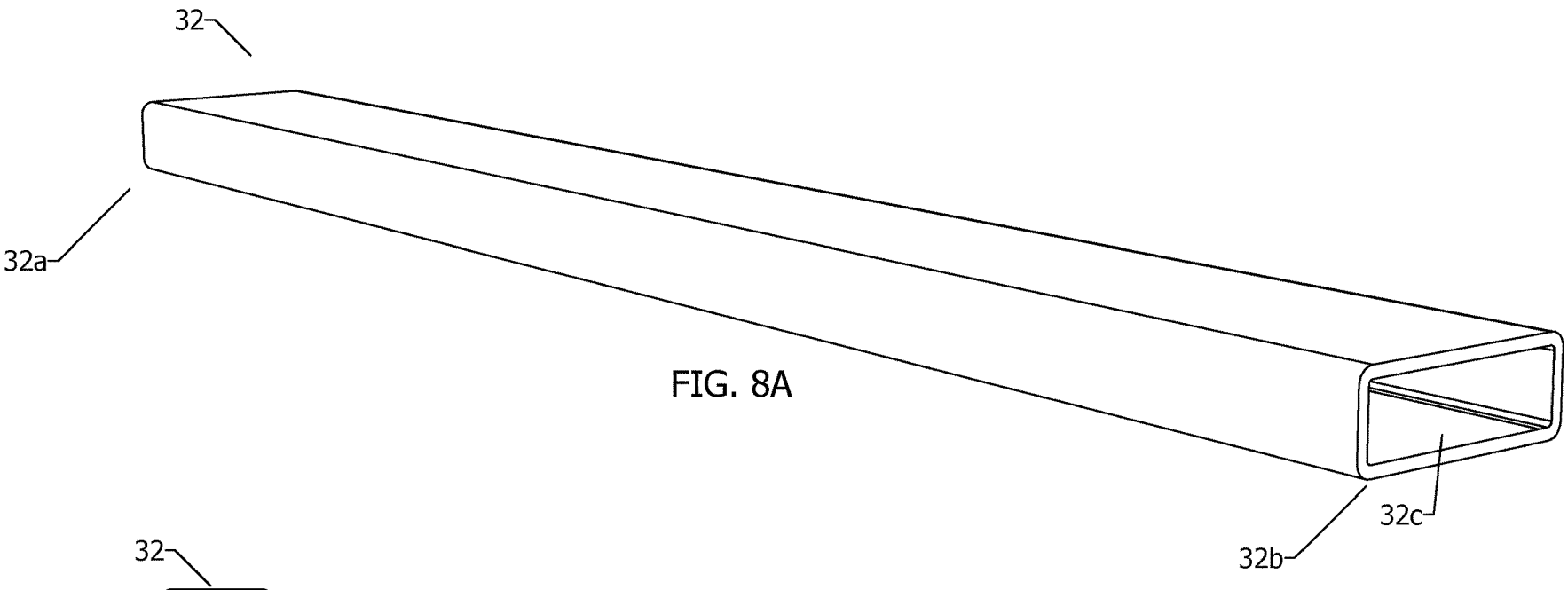
FIG. 8A is a front left perspective view of an embedded stair tread of the stair assembly of FIG. 1.
Figure 8B:
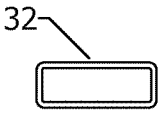
FIG. 8B is a front elevational view of the embedded stair tread of FIG. 8A.

Referring to FIGS. 8A and 8B, the embedded stair tread 32 is preferably tubular or internally hollow and rectangular in cross-section. The embedded stair tread 32 may be formed of any material having suitable properties, including steel or wood (which preferably may be solid rather than tubular). Because the embedded stair tread 32 preferably has a uniform cross-section over its length, the cross-section of the embedded stair tread 32 may be seen in the front view, FIG. 8B, to be generally rectangular, with two pairs of opposing sides that are perpendicular to one another. Throughout this application, "rectangular" and "perpendicular" are used in a descriptive rather than geometric sense: the cross-section is described as rectangular despite the rounded corners or other deviations from a geometrically perfect rectangle. Moreover, an embedded stair tread 32 may have a different cross-section from what is shown, as long as the embedded stair tread is compatible with the shape and dimensions necessary to a particular use of the assembly.

Figure 10A:
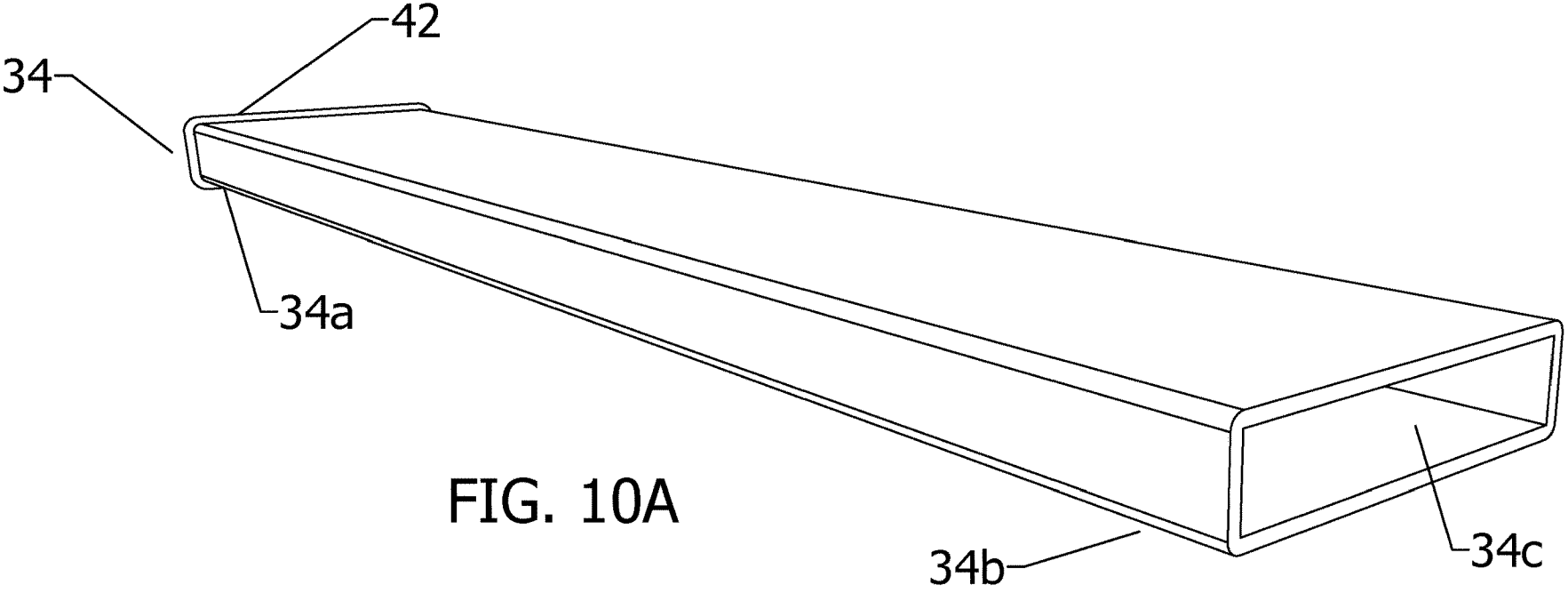
FIG. 10A is a front left perspective view of an outer stair tread of the stair assembly of FIG. 1.
Figure 10B:
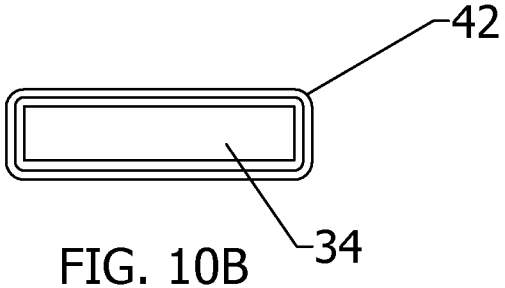
FIG. 10B is a front elevational view of the outer stair tread of FIG. 10A.
Figure 11:
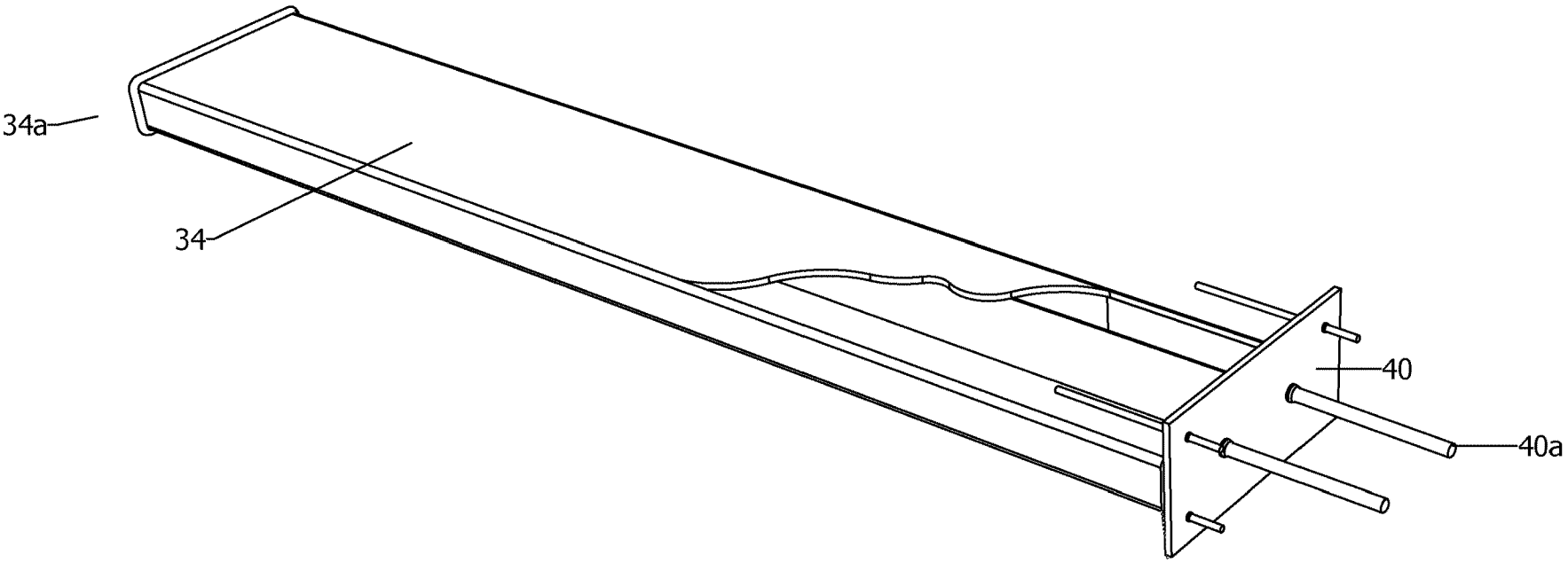
FIG. 11 is a rear right perspective view of the outer stair tread of FIG. 10A and an outer stair tread plate and bolts of the preferred embodiment.

Similarly, referring to FIGS. 10A and 10B, the outer stair tread 34 is preferably tubular or internally hollow and has a first end 34*a*, a second end 34*b*, and a longitudinal axis 34*c*. The outer stair tread 34 may be formed of any material having suitable properties, including steel (preferably with a powder-coated finish). Because the outer stair tread 34 preferably has a uniform cross-section over its length, the cross-section of the outer stair tread 34 may be seen in the front view, FIG. 10B, to be generally rectangular, with two pairs of opposing sides that are perpendicular to one another. An outer stair tread 34 may have a different cross-section from what is shown, as long as the stair tread 34 has the shape and dimensions necessary to a particular use.

Referring to FIGS. 1, 2, 10A, 10B and 11, although the cantilever stair tread assembly 10 is compatible with cantilever installation with use of the inner wall stair tread bracket 14, the cantilever stair tread assembly 10 may optionally be configured to engage a structure opposite the inner wall stair bracket 14. An outer stair tread plate 40 is optionally welded or otherwise fastened to the outer stair tread 34 at an opposite end thereof from the stair tread plate 30 to become part of the stair tread module 28. The outer stair tread 40 preferably has one or more apertures for fasteners and may have one or more horizontally oriented fasteners, for example bolts 40*a*, fixed thereto for engaging a structure.

Figure 12:
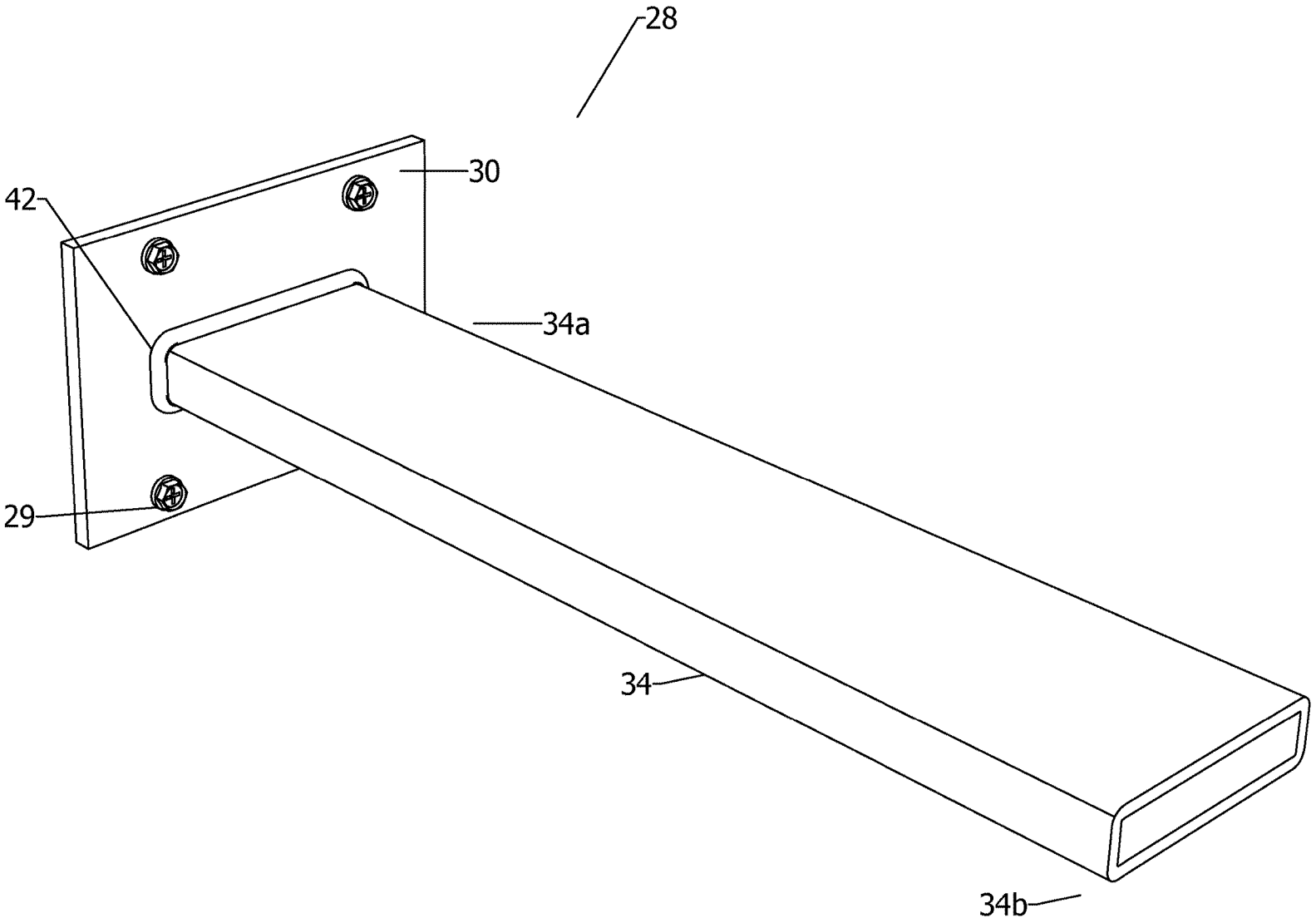
FIG. 12 is a front left partial perspective view of a cantilever stair assembly in accordance with a second preferred embodiment of the present invention.

The present invention in certain preferred embodiments also permits true cantilever installation with the free end 34*b* of the outer stair tread 34 being free, as shown in FIG. 12. Fasteners in the form of bolts 29 preferably attach the tread module 28 to the building structure.

Referring to FIGS. 1, 2 and 7A-7D, under standard building codes and practices, the vertical support member 12 may require structural hold-down supports 36, which as shown in FIGS. 1, 2, are adapted to be secured to the studs 12*a*, 12*b* and to an upper or lower support structure, typically floor or ceiling structures (not shown). The preferred structural hold-down support 36, which has a first hole 36*a* adapted for a vertical fastener, shown as a bolt 38 (FIG. 1), for securing to a floor, ceiling, or other horizontal structure, and at least one (a plurality are shown) of second holes 36*b* for securing the structural hold-down support 36 to a vertical member such as the vertical member 12 of FIGS. 1 and 2. A variety of structural hold-down supports 36 are contemplated and may be employed as needed in conjunction with the preferred invention.

The preferred present invention has been primarily described as applied to traditional construction, in which the assembly engages the vertical support member 12 located within a building wall. The preferred stair tread module 28 also may be installed in walls of brick, masonry, stone, and the like, in which the stair tread module 28 may be fixed to the wall itself rather than to a freestanding vertical support member 12 or a vertical member or stud located within a wall.

Figure 13:
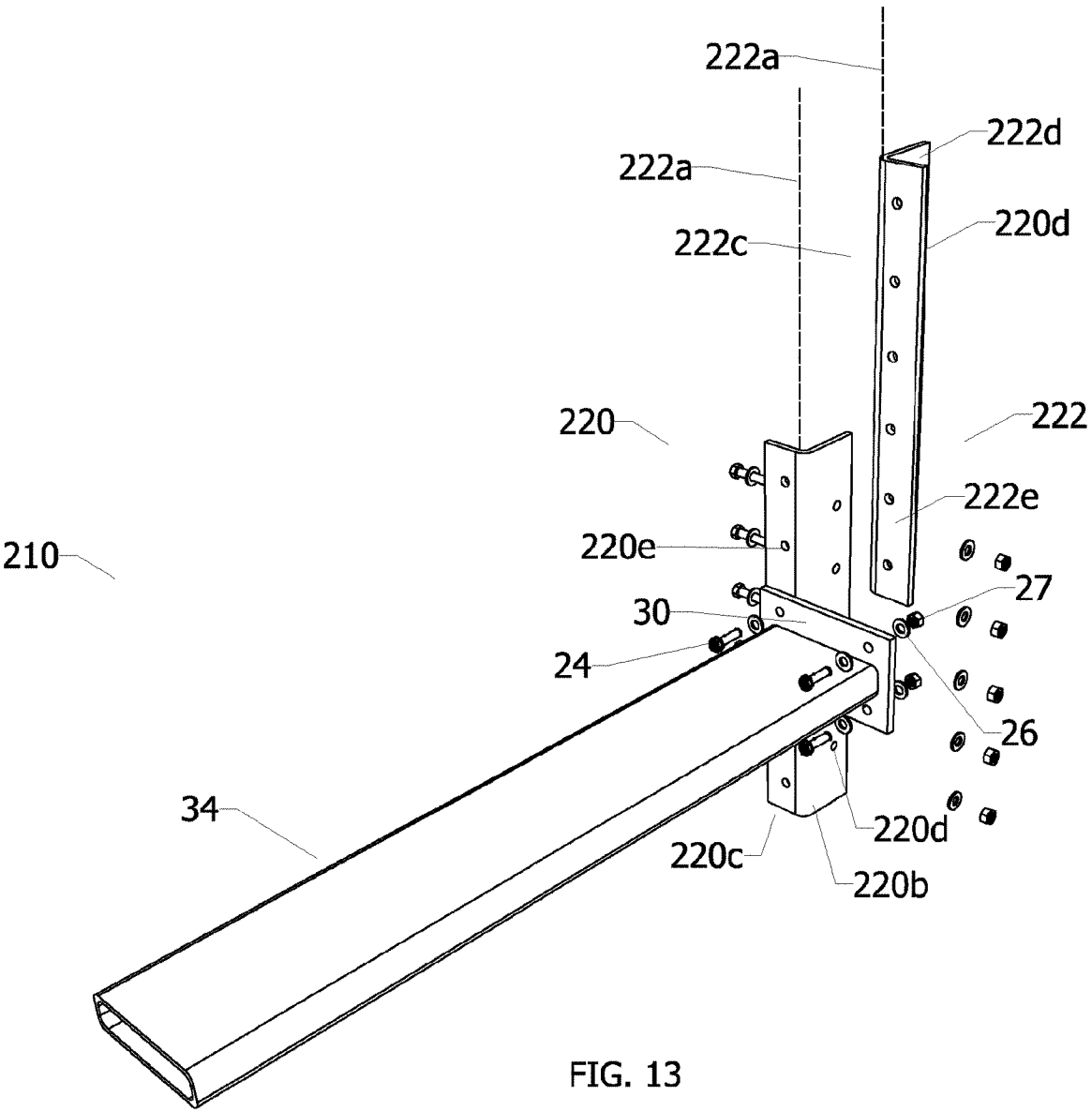
FIG. 13 is front right perspective view of a partial cantilever stair assembly in accordance with a third preferred embodiment of the present invention.

Referring to FIG. 13, a third preferred embodiment of the present invention is directed to an inner wall stair tread assembly 210. Referring to FIGS. 1, 2 and 13, the inner wall stair tread assembly 210 is configured to be attached to a vertical support member 12. The vertical support member 12 is preferably formed from a pair of timber studs 12*a*, 12*b* forming a portion of a wall of a building, with each timber stud 12*a*, 12*b* having a face 13 parallel to the surface of the wall. As in the first and second preferred embodiments of FIGS. 1-12, the vertical support member 12 could alternatively be any structural member having the necessary dimensions and strength—for example, a stud or post made from steel or other material. The inner wall stair tread assembly 210 connects to the vertical support member 12 by way of first and second inner wall stair tread supports 220, 222, which are mounted and attached to opposite sides of the vertical support member 12.

Each inner wall stair tread support 220, 222 has a longitudinal axis 220*a*, 222*a*, a first plate 220*b*, 222*b*, and a second plate 220*c*, 222*c*. Each first plate 220*b*, 222*b* may be perpendicular to the respective second plate 220*c*, 222*c*. Each inner wall stair tread support 220, 222 also preferably has a support-member-engagement hole 220*d*, and may have a plurality of support-member-engagement holes 220*d*, passing through each first plate 220*b*, 222*b* and preferably has a stair-tread-plate-engagement hole 220*e*, and may have a plurality of stair-tread-plate-engagement holes 220*e*, 222*e* passing through each second plate 220*c*, 222*c*. A plurality of fasteners, not shown in FIG. 13, but preferably comprising a plurality of wood screws 25 (FIG. 6), is adapted to pass through one or more of the support-member-engagement holes 220*d* to secure each inner wall stair tread support 220, 222 to the vertical support member 12.

Figure 5A:
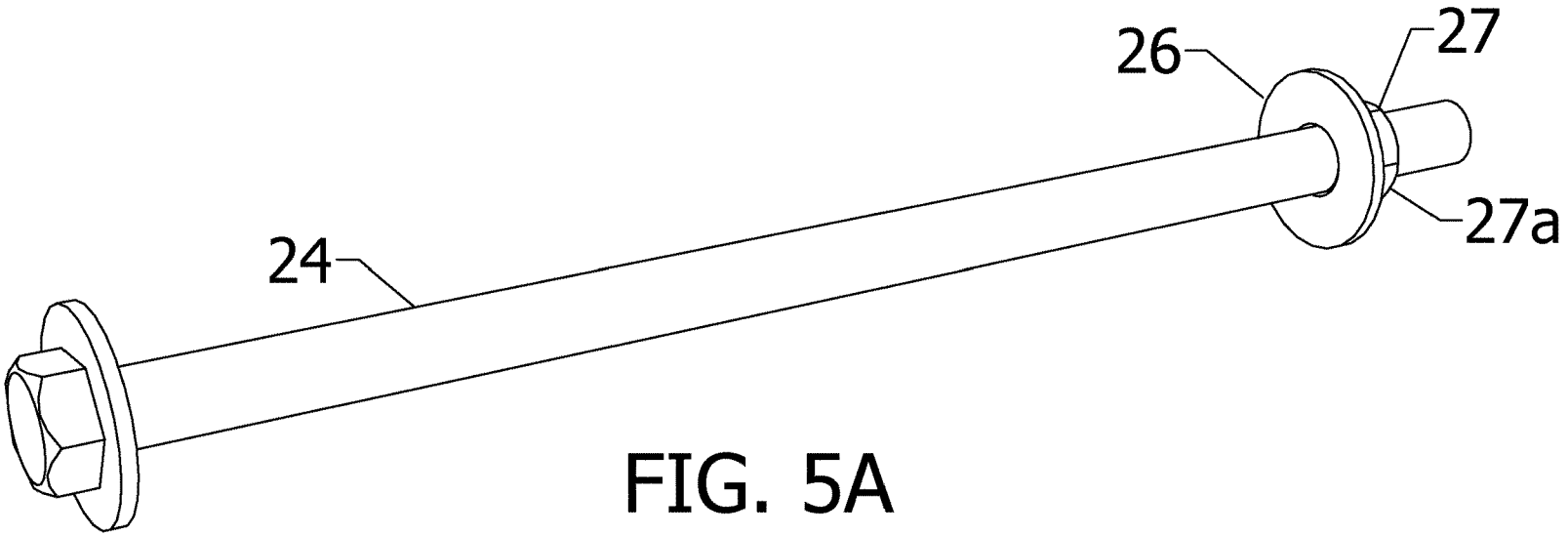
FIG. 5A is a front perspective view of a fastener of the stair assembly of FIG. 1.
Figure 5B:
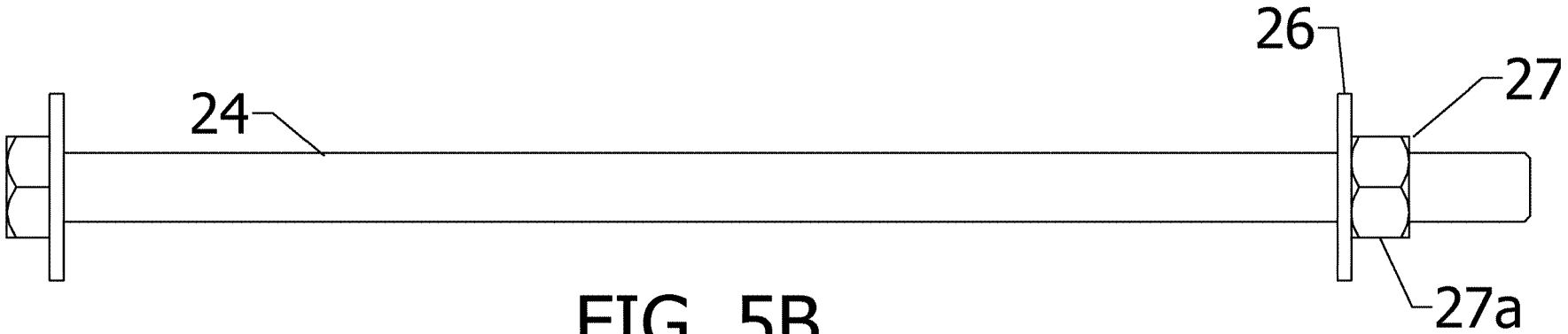
FIG. 5B is an front elevational view of the fastener of FIG. 5A.
Figure 6:
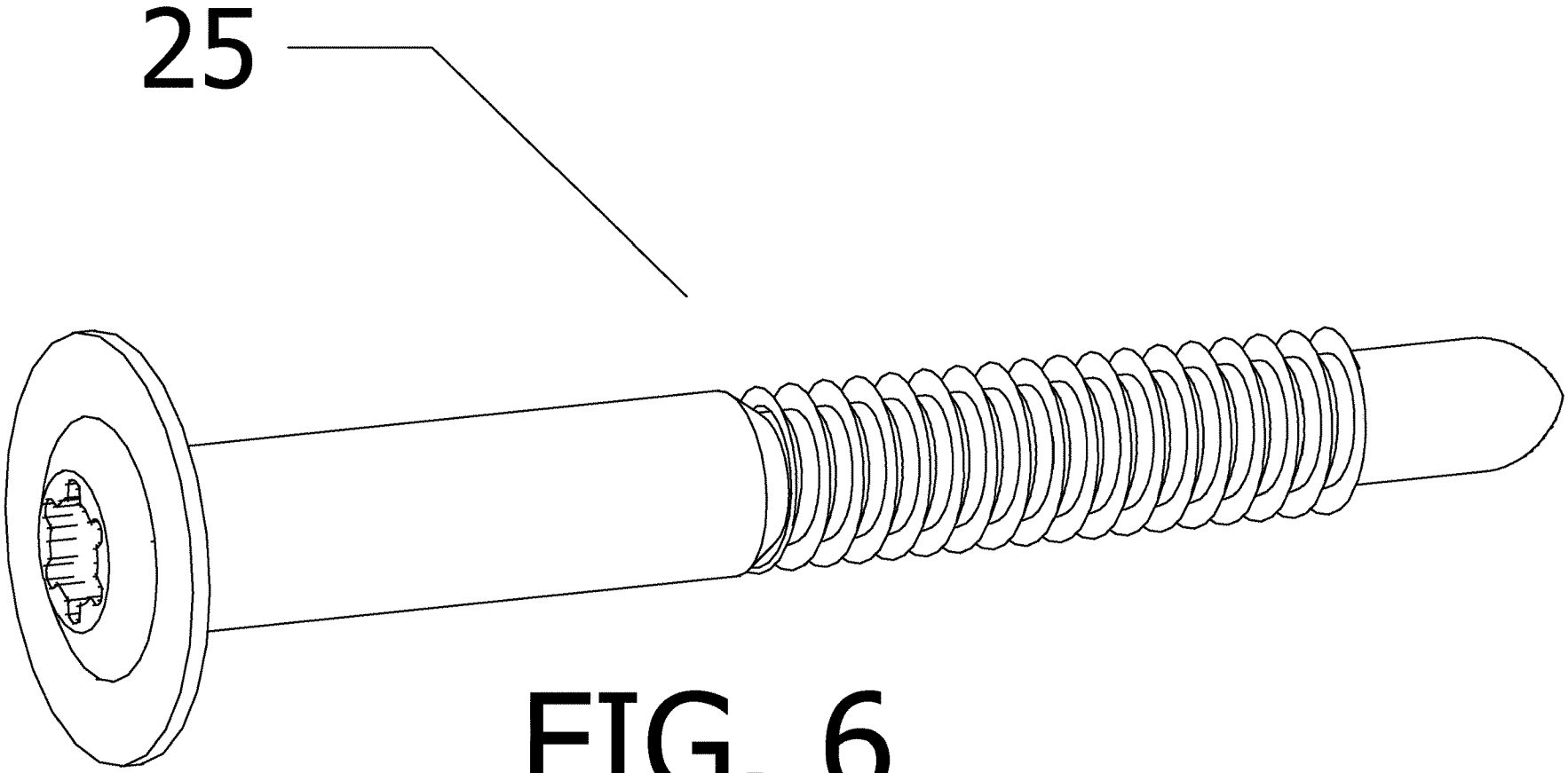
FIG. 6 is a side perspective view of a second fastener of the stair assembly of FIG. 1.
Figure 7A:
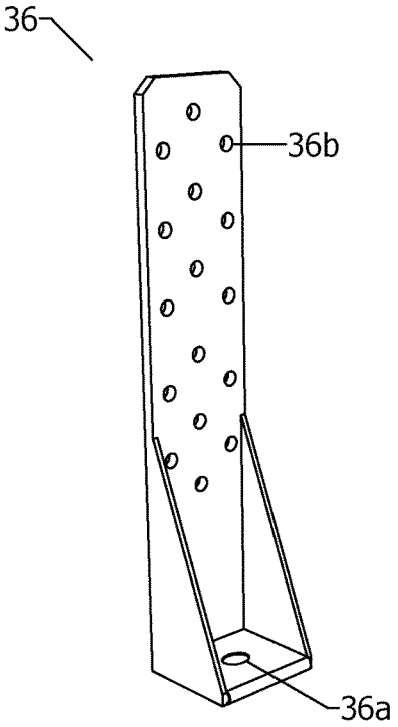
FIG. 7A is a front left perspective view of a structural hold down support of the stair assembly of FIG. 1.
Figure 7B:
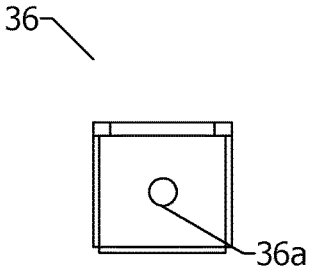
FIG. 7B is a top plan view of the structural hold down support of FIG. 7A.
Figure 7C:
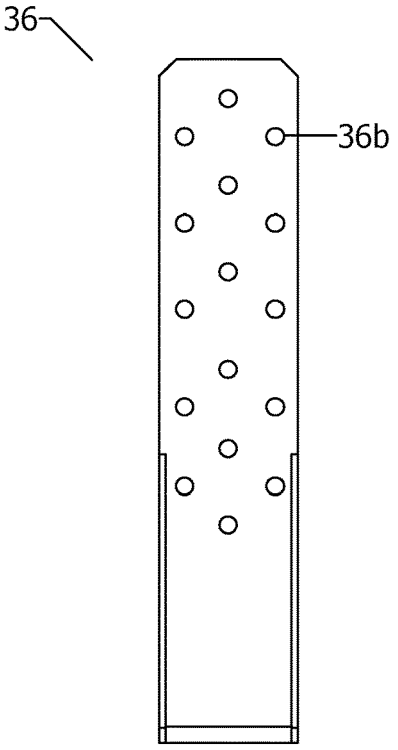
FIG. 7C is a front elevational view of the structural hold down support of FIG. 7A.
Figure 7D:
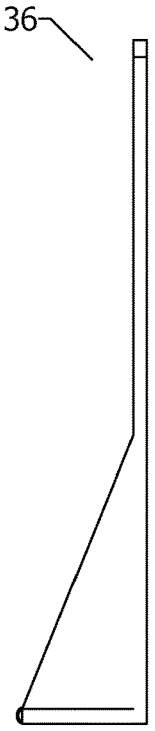
FIG. 7D is a left side elevational view of the structural hold down support of FIG. 7A.

Referring to FIGS. 5A, 5B and 13, the inner wall stair tread assembly 210 further comprises a stair tread plate 30, as also depicted in the first preferred embodiment of FIGS. 1-12 and as described above. The stair tread plate 30 is preferably fastened to each inner wall stair tread support 220, 222 by at least one, and preferably by a plurality of fasteners in the form of inner wall stair tread bracket bolts 24 engaged with the stair-tread-plate-engagement holes 220*e*, 222*e* passing through each second plate 220*c*, 222*c* to join the stair tread plate 30 to the vertical support member 12 and the studs 12*a*, 12*b*. Each inner wall stair bracket bolt 24 is preferably secured by a washer 26 and a nut 27. The washer 26 may optionally take the form of a combination lock nut-washer, and as used herein, "washer" includes combination lock nut-washers as well as conventional washers. The nut 27 preferably is coated with vinyl and thus has a vinyl surface 27*a*. Examples of suitable bolts, nuts, and washers are shown in in FIGS. 5A and 5B, but a variety of other bolts, screws, and fasteners may be used. For example, a wood screw 25, such as the example shown in FIG. 6, may be substituted for one or more of the stair tread bracket bolts 24. In a preferred embodiments, the bolts 18*a* are sufficiently long to accommodate a thickness of a wall material that may be arranged between the face 13 of the vertical support member 12 and the external surface (not shown) of the building wall. In practice, bolts one-half inch in diameter and at least two inches (2") in length are effective in many applications, but other dimensions are possible and are generally consistent with the requirements of the assembly, as long as they are able to generally withstand the normal operating conditions of the bolts and perform the preferred functions of the bolts, as is described herein.

Referring to FIGS. 1, 2, 12 and 13, the stair tread plate 30 is attached to an embedded stair tread 32 having a first end 32*a*, a second end 32*b*, and a longitudinal axis 32*c*; and an outer stair tread 34 having a first end 34*a*, a second end 34*b*, and a longitudinal axis 34*c*, as best seen in FIGS. 1 and 2. As previously discussed with respect to FIGS. 1-12, the stair tread plate 30 is preferably a planar body with a square shape measuring about ten inches (10") on each side and preferably about half an inch (½") in thickness. The stair tread 34 is preferably attached to the stair tread plate 30 as depicted in FIGS. 8A-10B and described above. The stair tread 34 is preferably formed as shown and described above.

Referring to FIGS. 1, 2, 10A, 10B, 11, and 13, although the cantilever stair tread assembly 10, 210 is compatible with cantilever installation, the cantilever stair tread assembly 10, 210 may optionally be configured to engage a structure opposite the vertical support member 12. An outer stair tread plate 40 is optionally welded or otherwise fastened to the embedded stair tread 32, or to the outer stair tread 34, or to both. The outer stair tread plate 40 preferably has one or more apertures for fasteners and may have one or more horizontally oriented fasteners, for example bolts 40*a*, fixed thereto for engaging a structure.

The present invention in certain preferred embodiments also permits true cantilever installation with the free end 34*b* of the outer stair tread 34 being free, as shown in the second preferred embodiment of FIG. 12.

Referring to FIGS. 1, 2 and 7A-7D, with respect to any of the preferred embodiments of the invention described herein, standard building codes and practices may require that the vertical support member 12 be secured by structural hold-down supports 36, as described above.

The preferred embodiments of the present invention have been primarily described as applied to traditional construction, in which the assembly 10, 210 engages the vertical support member 12 located within a building wall. The preferred embodiments of the invention may also be used to install outer stair treads 34 in walls of brick, masonry, stone, metallic structural support and the like, in which the outer stair tread 34 may be fixed to the wall itself rather than to a freestanding vertical support member 12 or a vertical member or stud located within a wall.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present disclosure as defined by the appended claims.

I claim:

1. A cantilever stair assembly comprising:

a stud forming a portion of a wall of a building, the wall having an outer wall surface, and the stud being a vertical support member of a frame of the building;

a stair tread module including a stair tread extending outwardly from the outer wall surface, a stair tread plate for supporting the stair tread, and a support portion for engaging the stud and supporting the stair tread plate on the stud, wherein the stair tread has a first end, and second end, and a cross-sectional shape, the cross-sectional shape being uniform from the first end to the second end thereof, and wherein the stair tread plate has a tread hole, the tread hole and first end of the stair being complementarily shaped, the first end of the stair tread being positioned within the tread hole and welded directly to the stair tread plate and is thereby fixed in position in the tread hole.

2. The cantilever stair assembly of claim 1, wherein the cantilever stair assembly includes a plurality of stair tread modules.

3. The cantilever stair assembly of claim 1, further comprising:

an inner wall stair tread bracket and an inner wall tread bracket support for mounting to opposite sides of a vertical support member, the inner wall tread bracket support having at least one support-member-engagement hole for a fastener for engaging the vertical support member, and the inner wall stair tread bracket having a support-engagement section with a support-member-engagement hole and a stair-base support section having a plate oriented vertically and perpendicular to the stair tread, the plate having a horizontal fastener fixed thereto, with the horizontal fastener having a body oriented horizontally, wherein the stair tread plate of the stair tread module is secured to the horizontal fastener.

4. The cantilever stair assembly of claim 3, wherein the horizontal fastener is a bolt welded to the stair-base support section.

5. The cantilever stair assembly of claim 3, wherein the cantilever stair assembly includes a plurality of the stair tread modules.

6. The cantilever stair assembly of claim 1, further comprising:

an outer stair tread plate for engaging a structure, the outer stair tread plate being fastened to the stair tread at an opposite end thereof from the stair tread plate.

7. A cantilever stair assembly comprising:

a stair tread module including a stair tread plate having a tread hole, first and second mounting holes, and an embedded stair tread inserted into and fixed within the tread hole, wherein the stair tread module further includes a first inner wall stair tread support and a second inner wall stair tread support for mounting to opposite sides of a vertical support member, each of the first and second inner wall stair tread supports has a first plate with a support-member-engagement hole therethrough, and each of the first and second inner wall stair tread supports has a second plate perpendicular to the first plate thereof, and each second plate is oriented vertically and perpendicular to the stair tread and has a stair-tread-plate-engagement hole therethrough, wherein the first and second mounting holes of the stair tread plate are respectively aligned with and secured to the stair-tread-plate-engagement hole of each of the first and second inner wall stair tread supports.

8. The cantilever stair assembly of claim 7, wherein the first plate of each of the first and second inner wall stair tread supports has a plurality of support-member-engagement holes therethrough, and the second plate of each of the first and second inner wall stair tread supports has a plurality of stair-tread-plate engagement holes, and each of the first and second inner wall stair tread supports is mounted to the vertical support member by at least one fastener passing through at least one of the plurality of support-member-engagement holes, and wherein the stair tread plate is secured directly to each of the first and second inner wall stair tread supports by at least one fastener passing through at least one of the stair-tread-plate-engagement holes of each of the first and second inner wall stair tread supports.

9. The cantilever stair assembly of claim 7, wherein the first inner wall stair tread support has a longitudinal axis and a cross section perpendicular thereto, the cross section having a base with a first end having a first leg angled with respect to the base, and a second end having a second leg angled with respect to the base, the base, the first leg, and the second leg together forming a C-shape.

10. The cantilever stair assembly of claim 8, wherein the first inner wall stair tread support has a longitudinal axis and a cross section perpendicular thereto, the cross section having a base with a first end having a first leg angled with respect to the base, and a second end having a second leg angled with respect to the base, the base, the first leg, and the second leg together forming a C-shape.

11. The cantilever stair assembly of claim 7, wherein the cantilever stair assembly includes a plurality of the stair tread modules including a plurality of the stair tread plates, and wherein in the plurality of stair tread plates, each stair tread plate has exactly one stair tread fixed thereto.

12. A cantilever stair assembly for attachment to at least one vertical support member forming a portion of a wall of a building, the cantilever stair assembly comprising:

a stair tread module including a stair tread extending outwardly from a stair tread plate for supporting the stair tread, and a support portion for engaging the vertical support member and supporting the stair tread plate on the vertical support member, wherein the stair tread has a first end, and second end, and a cross-sectional shape, the cross-sectional shape being uniform from the first end to the second end thereof; and wherein the stair tread plate has a tread hole, the tread hole and first end of the stair are complementarily shaped, and the first end of the stair tread is positioned within the tread hole and fixed directly to the stair tread plate by being fixed in the tread hole.

13. The cantilever stair assembly of claim 12, wherein the cantilever stair assembly includes a plurality of stair tread modules.

14. The cantilever stair assembly of claim 12, further comprising:

an inner wall stair tread bracket and an inner wall tread bracket support for mounting to opposite sides of the vertical support member, the inner wall tread bracket support having at least one support-member-engagement hole for a fastener for engaging the vertical support member, and the inner wall stair tread bracket having a support-engagement section with a support-member-engagement hole and a stair-base support section having a plate oriented vertically and perpendicular to the stair tread, the plate having a horizontal fastener fixed thereto, with the horizontal fastener having a body oriented horizontally, wherein the stair tread plate of the stair tread module is secured to the horizontal fastener.

15. The cantilever stair assembly of claim 14, wherein the horizontal fastener is a bolt welded to the stair-base support section.

16. The cantilever stair assembly of claim 14, wherein the cantilever stair assembly includes a plurality of the stair tread modules.

17. The cantilever stair assembly of claim 12, further comprising:

an outer stair tread plate for engaging a structure, the outer stair tread plate being fastened to the stair tread at an opposite end thereof from the stair tread plate.

* * * * *